US007436369B2

(12) United States Patent
Apostolos

(10) Patent No.: US 7,436,369 B2
(45) Date of Patent: Oct. 14, 2008

(54) CAVITY EMBEDDED MEANDER LINE LOADED ANTENNA AND METHOD AND APPARATUS FOR LIMITING VSWR

(75) Inventor: John T. Apostolos, Merrimack, NH (US)

(73) Assignee: BAE Systems Information And Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/584,842

(22) PCT Filed: Dec. 31, 2003

(86) PCT No.: PCT/US03/41777

§ 371 (c)(1),
(2), (4) Date: Jun. 27, 2006

(87) PCT Pub. No.: WO2005/069442

PCT Pub. Date: Jul. 28, 2005

(65) Prior Publication Data

US 2007/0115199 A1 May 24, 2007

(51) Int. Cl.
*H01Q 11/12* (2006.01)
*H01Q 1/42* (2006.01)

(52) U.S. Cl. ..... 343/741; 343/789

(58) Field of Classification Search ..... 343/744, 343/749, 741, 700 MS, 742, 789, 866, 895
See application file for complete search history.

(56) References Cited

U.S. PATENT DOCUMENTS 6,373,446 B2 * 4/2002 Apostolos ..... 343/797
6,828,947 B2 * 12/2004 Apostolos et al. ..... 343/895
6,833,815 B2 * 12/2004 Apostolos ..... 343/700 MS
6,999,037 B2 * 2/2006 Apostolos ..... 343/767

* cited by examiner

*Primary Examiner*—Hoang V Nguyen
(74) *Attorney, Agent, or Firm*—Daniel J. Long; Robert K. Tendler

(57) ABSTRACT

A wideband meander line loaded antenna is configured to be flush mounted to a conductive surface serving as a ground plane by embedding the meander line components within a conductive cavity surrounded at its top edge by the ground plane. The antenna thus looks out of a cavity recessed in the surface. By permitting flush mounting the meander line antenna, not only can the antenna dimensions be minimized due to the use of the meander line loaded antenna configuration, but in aircraft applications no part of the antenna exists above the skin of the aircraft, thereby to minimize turbulent flow. Also disclosed is a method and apparatus in which a lossy dielectric is placed across the feed points of a loop type meander line loaded antenna to markedly decrease the VSWR to below 3:1, thus to increase the bandwidth of a relatively wideband 3:1 meander line loaded antenna to 6:1.

17 Claims, 10 Drawing Sheets

CAVITY EMBEDDED MEANDER LINE LOADED ANTENNA AND METHOD AND APPARATUS FOR LIMITING VSWR

This application is a 371 of PCT/US03/41777 dated Dec. 31, 2003.

FIELD OF INVENTION

This invention relates to meander line loaded antennas in more particularly to a configuration of the meander line loaded antenna involving a cavity and embedding the antenna in the cavity, thereby permitting flush mount operation. This invention also relates to methods and apparatus for limiting the VSWR in meander line loaded antennas.

BACKGROUND OF THE INVENTION

In the past, and as illustrated in U.S. Pat. No. 6,323,814 by John T. Apostolos, entitled Wideband Meander Line Loaded Antenna, assigned to the assignee hereof, and incorporated herein by reference, wide bandwidth miniaturized antennas can be provided through the utilization of planner conductors which are fed through a so-called meander line which involves impedance changes to reduce the physical size of the antenna while at the same time permitting wideband operation.

The plates of the meander line loaded antennas are configured to exist above a ground plane and are spaced therefrom, with a meander line connecting a top plate or element to the ground plane. For operation in the 225 MHz to 2 GHz range, the height of the plates which are spaced from the ground plane can exceed five inches. Were the meander line loaded antennas operate down to 100 MHz, then the height above the ground plane would be on the order of ten inches;

For vehicle top applications when using an above-the-ground plane meander line loaded antenna, a ten-inch or more dome would have to be employed on the car top which is both unsightly and which can increase turbulent flow behind the antenna at vehicle speeds.

When these antennas are utilized on supersonic aircraft, anything having hard edges and existing above the skin of the fuselage results in intolerable turbulence which cuts down the efficiency of the aircraft.

in the past, for aircraft operation, a flush-mounted crossed slot antenna has been utilized in which slots depend down into a cavity some five inches. However in the application the overall size of the antenna is 30×30 inches. As a result, these yard square antennas require a significant amount of real estate on the skin of the aircraft, which real estate is in short supply.

There is therefore need to provide a small wideband flush mount antenna which does not affect aircraft aerodynamics while at the same time providing the required wideband performance.

Whether for a cell phone, PCS, 802.11 and/or GPS application such as that which is required for either hand held wireless communication devices or for use in vehicle mounted apparatus, or for use in either satellite communications from an aircraft or for VHF communications from the aircraft to the ground, what is required is an exceedingly small flush mount antenna which has a wideband frequency response.

Such a wideband frequency response is possible with the apparatus described in U.S. Pat. No. 6,323,814 and more particularly in co-pending patent application Ser. No. 10/123,787, filed Apr. 16, 2002 assigned to the assignee hereof the incorporated herein by reference. in this patent application the low frequency cut off of the meander line loaded antenna is decreased due to a cancellation of the reactance of the antenna by the reactance of the meander line and parasitic capacitance.

It was not at all obvious that a meander line loaded antenna in which the plates of the antenna existed above a ground plane could be submerged in a conductive cavity. It was also not immediately obvious that one could obtain the reactance cancellation obtainable in an above-the-ground plane meander line loaded antenna when using any kind of cavity.

Note, when others have attempted to flush mount antennas, the size of the cavities involved were such to preclude their use due to the massive size of the cavity involved.

Also, it was not clear that the gain of the antenna at the zenith and horizon would match the same characteristics as those of an above-the-ground plane meander line loaded antenna, especially when in a loop mode. It will be appreciated that having a horizon gain that approximates that of the gain at the zenith is quite important for omnidirectional general coverage for the antenna. For instance, if one is in a vehicle and one wants coverage at the horizon where cell sites are located, then it is important that the gain in the horizontal direction be such as to robustly communicate with the cell sites.

Moreover, if the antenna is utilized in a GPS mode, it will be appreciated that the horizontal dilution of position is much smaller when signals comes from satellites at or near the horizon, as opposed to satellites which are directly overhead. Thus, the gain of the antenna towards the horizon is indeed a critical factor and one which could not be predicted from a meander line antenna with a plate above its ground plane.

Thus, it is important for flush mount applications to be able to replace the crossed-slot flush mount antenna which is a yard by a yard in area with one with considerably reduced dimensions. This type of real estate savings is indeed important not only in aircraft but also in terrestrial vehicles where appearance is important.

Those skilled in the art will also appreciate that meander line loaded antennas such as described in U.S. Pat. Nos. 5,790,090; 6,313,716; 6,323,814; 6,373,440; 6,373,446; 6,480,158; 6,492,953; and 6,404,391 are known in which various techniques are utilized to create an ultrawide bandwidth for the antennas.

One antenna, called a cavity embedded meander line loaded antenna as described in U.S. patent application Ser. No. 10/251,131 filed by John T. Apostolos on Sep. 20, 2002 and incorporated herein by reference, involves a meander line loaded antenna flush mounted to the skin of an aircraft. It is a relatively wide bandwidth antenna, with a 3:1 ratio of high frequency cutoff to low frequency cutoff.

While such a 3:1 ratio is indeed quite useful in most applications, an even wider bandwidth would be appropriate for a number of applications. The problem associated with lowering the VSWR at least below 1800 MHz is that while the VSWR can be lowered significantly by placing a capacitor across the feed points to the meander line loaded antenna, it shorts out the antenna above 1800 MHz. Thus, a VSWR of less than 3:1 is possible for frequencies such as between 500 MHz and 1800 MHz.

However, since the capacitor acts to short the feed point above 1800 MHz, the use of a capacitor limits the potential upper band limit of such an antenna.

It will be appreciated that this type of cavity embedded meander line loaded antenna can be characterized as a loop type meander line loaded antenna in that a loop exists between the feed point across the top plate, down the cavity side, across the cavity bottom and up to the feed point. This loop path is like a coil and is responsible for inductive impedance which must be canceled if one is to have a low VSWR.

While the embedded cavity meander line loaded antenna can be characterized as a loop type antenna, so can the standard meander line loaded antennas in which the loop is formed from the feed point, across a top plate, across the meander line to an upstanding plate, through the ground plate and then up to the feed point. in fact, most standard meander line loaded antennas which are not embedded are of this type of configuration. These antennas are only broadbanded to the extent that the VSWR is relatively low across the entire band; and for that reason it is important to be able to cancel loop-induced inductive impedance at those frequencies at which inductive impedance is a factor.

SUMMARY OF THE INVENTION in the subject invention a flush-mounted meander line loaded antenna is identical in size and design to the meander line loaded antenna described above except for the location of the elements in a conductive cavity. As a result, the antenna is built at the top portion of the conductive cavity such that the top plates of the antenna are flush with a surrounding ground plane surface that meets the upper edge of the cavity. It is a feature of the subject invention that the meander line loaded antenna elements are at or below the plane of the conductive surface which carries the cavity. It is also important that the cavity volume be designed to be greater than 0.003 times the cube of the lowest frequency wavelength so as to guarantee maximum efficiency. It has been found that the subject cavity mounted antenna is governed by the Chu-Harrington relationship in which a form factor times Q, the quality factor, multiplied by the volume of the cavity divided by the cube of the wavelength in fact establishes maximum efficiency.

The way the cavity configuration is designed is to design the antenna conventionally and then having the dimensions of its top plates design a cavity whose volume is optimum as established by Chu-Harrington.

It will be appreciated that the Chu-Harrington relationship was developed for antennas which existed above a ground plane. It is the finding of the subject invention that a similar relationship holds for below ground plane antennas.

Moreover, it has been found that the gain at the zenith of the antenna and the gain at the horizon mimics exactly that of meander line loaded antennas in which the plates are above the ground plane.

What this means is that a flush mount antenna may be provided either for vehicles or aircraft, or indeed for handheld or portable devices such as laptop computers in which the antenna characteristics match those of prior meander line loaded antennas. These prior meander line loaded antennas are characterized by their small size and wideband characteristics. With the subject antenna, not only are these thereby to minimize turbulent flow. Moreover, when adapted to wireless handsets or laptop computers, the depth or thickness of the unit need not be increased when providing a wideband antenna, thus to minimize the overall dimensions of the device. Additionally, the flush mounted meander line antenna when utilized in the roof of a vehicle such as a car does not result in an unsightly protrusion from the top of the car, but rather is hidden in the recessed cavity, thereby permitting providing the vehicle with a wideband antenna which covers not only cellular frequencies but also the PCS band, the 802.11 band and GPS frequencies.

It has also been found that by placing a lossy dielectric material across the feed point of a loop type meander line loaded antenna the VSWR below 1800 MHz is drastically reduced below 3:1 from VSWR spikes as high as 15:1. Also the VSWR curve is noticeably smoothed by the dielectric material, thus eliminating VSWR spikes below 1800 MHz.

The reason that the lossy dielectric is useful is that because below 1800 MHz the lossy dielectric serves as a capacitor bridging the feed point and has all of the above advantages associated with the use of a capacitor across the feed.

Above 1800 MHz, the resistance of the lossy dielectric increases with frequency. What occurs is that, while the capacitive nature of the lossy dielectric below 1800 MHz dominates to reduce VSWR, above 1800 MHz the shorting action referred to above is eliminated by virtue of the resistance of the lossy dielectric. This means that above 1800 MHz a meander line loaded antenna that is loaded across its feed point with a lossy dielectric behaves as if the lossy dielectric were not there. Thus above 1800 MHz it was as if there was no change to the original antenna.

The reason for the operation of the lossy dielectric in this manner is that each of the above antennas can be characterized as a loop type antenna in which an inductive coil essentially exists between the feed point and ground. This loop in fact constitutes an inductive impedance which in the lower frequencies oftentimes boosts the VSWR to unacceptable levels.

However, by canceling the inductive impedance below 1800 MHz through the use of the dielectric layer which acts as a capacitor, then the effective bandwidth of the antenna is extended downwardly from 1800 MHz.

in one embodiment, the lossy dielectric material is available from Eccosorb as model VF-30, which describes the layer as a resistive plastic film for microwaves. The material characteristics are that it is a conductive vinyl plastic film for 1 to 18 GHz, in which the material can be softened at higher temperatures and bonded to itself by heat sealing above about 270° F.

The original application for the Eccosorb VF-30 was to provide a liner for microwave cavities to eliminate internal reflections so that antenna patterns are not adversely affected by internal reflections.

Moreover, this particular material has been used as a free space microwave absorber if the film is spaced away from a metal surface by about a quarter of a wavelength.

Another application for the Eccosorb VF-30 is to limit the retro-reflectivity of metal surfaces to incoming microwave signals to limit radar cross-section. The use for this film therefore acts as an absorber of radar energy and is used in military applications to provide a certain amount of covert operation.

Note that the volume resistivity in ohm-centimeters is 5-50, with the dielectric constant at 8.6 GHz being 37, and the dissipation factor at 8.6 GHz being 1.15. In general, the standard thickness of the layer is 0.30 inches.

In one embodiment, a 1"×1" lossy dielectric Eccosorb VF-30 layer is placed in direct contact and adhesively attached to the feed points of the loop type meander line loaded antenna. Thus, rather than being utilized as a microwave absorber, in the subject application the material acts as a lossy dielectric to provide a capacitance across the feed points to limit the VSWR at frequencies below 1800 MHz.

In summary, a lossy dielectric is placed across the feed points of a loop type meander line loaded antenna to markedly decrease the VSWR to below 3:1, thus to increase the bandwidth of a relatively wideband 3:1 meander line loaded antenna to 6:1. in one embodiment, the lossy dielectric material functions as a capacitor across the feed point below 1800 MHz and serves as a resistor in series with the capacitor above the 1800 MHz so as not to short out the feed point above 1800 MHz. The result is VSWR for a loop type meander line loaded antenna of less than 3:1 across the entire bandwidth.

BRIEF DESCRIPTION OF THE DRAWINGS

These and other features are the subject invention will be better understood in connection with the Detailed Description in conjunction with the Drawings, of which.

DETAILED DESCRIPTION

Figure 1:
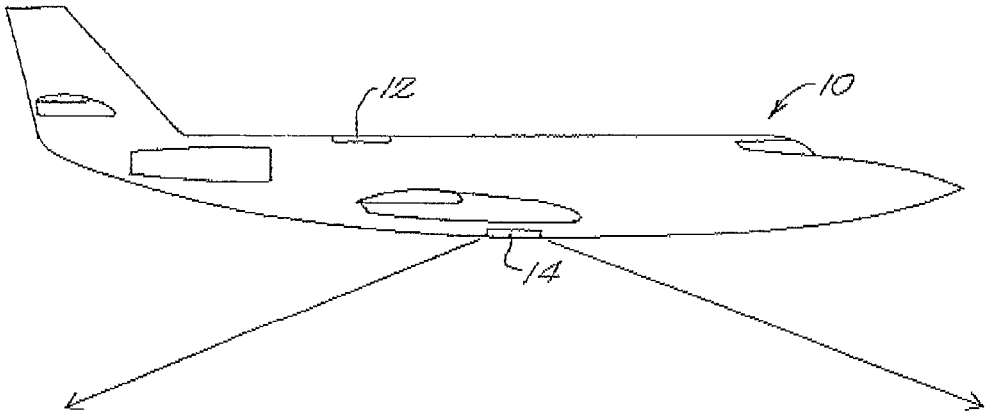
FIG. 1 is diagrammatic illustration of the utilization of wideband antennas on an aircraft, indicating their use for satellite communications and for VHF terrestrial communications.

Referring now to FIG. 1, in an aircraft application an aircraft 10 often times is provided with a UHF satellite communication antenna 12 on the top of the aircraft and/or a UHF communications antenna 14 at the belly of the aircraft. The purpose of the satellite communications antenna is, for instance, not only to establish two-way communications between the aircraft and a satellite but also to receive, for instance, GPS, GLONASS or Galileo navigation signals.

As to aircraft communications, there are aircraft bands lying in the VHF and UHF bands. Also at 220 MHz there is a vehicle band for vehicle tracking, communications and dispatch.

Figure 2:
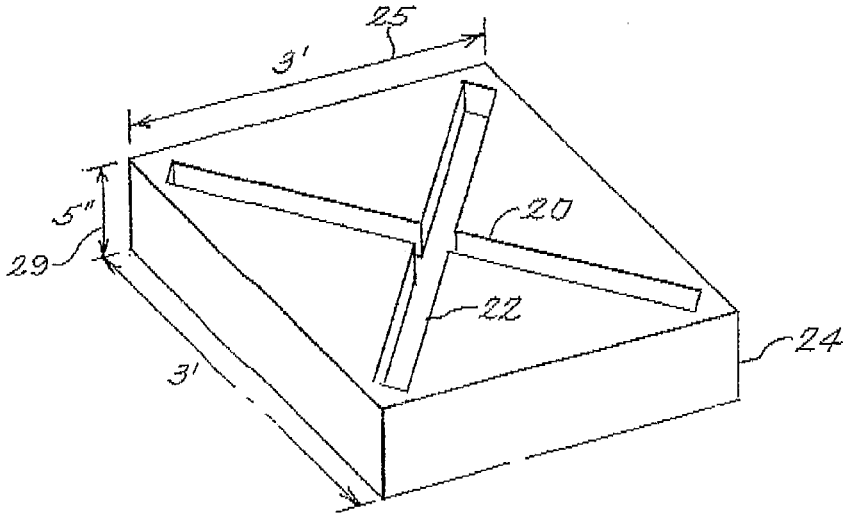
FIG. 2 (Prior Art)
FIG. 2 is a diagrammatic illustration of a crossed-slot antenna used in the prior art for wideband applications in which the antenna is carried in a cavity, but is unusually large in terms of the area occupied.

It will be appreciated that wideband antennas for such diverse applications are in fact quite large. For satellite communications alone, for a flush mounted crossed slot antenna, the overall real estate in one type of application is 30 inches by 30 inches, with a cavity depth of five inches. Such a prior art antenna is illustrated in FIG. 2 in which cross-slots 20 and 22 are located within a cavity 24 which has a 30-inch by 30-inch top surface and a five-inch depth as indicated by arrows 25, 27 and 29 respectively. This antenna is typically utilized for the 225 to 400 MHz range. However, its large size at one yard by one yard is difficult to justify in terms of real estate for use on an aircraft, especially when large numbers of antennas are to be utilized. If one where to reduce the antenna size by using above-the-ground plane meander line loaded antennas, these antennas would have a height of at least five inches and sometimes ten inches above the skin of the aircraft. As will be described, this produces turbulence and other factors which make this type of antenna undesirable.

Figure 3:
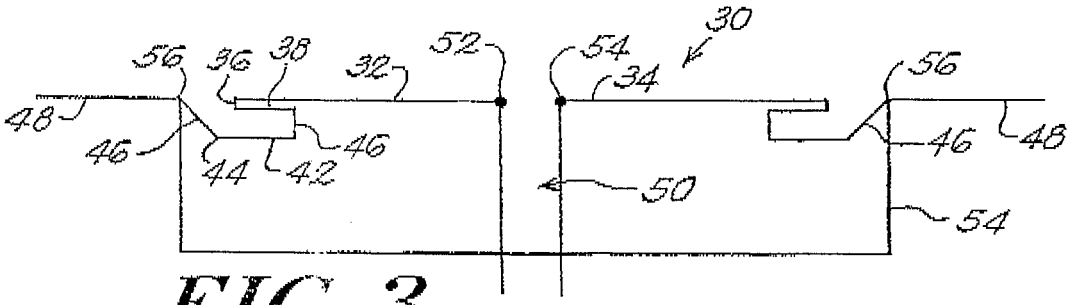
FIG. 3 is a diagrammatic and side view of the subject meander line loaded antenna illustrating its location within a cavity such that the top plates of the meander loaded antenna are flush with the surface surrounding the top edge of the cavity.

Referring now to FIG. 3, in the subject invention a meander line loaded antenna 30 includes top plates 32 and 34 for two diametrically opposed quad type antennas in which one edge of the top plate for each antenna is joined by a member 36 to a folded back portion 38 of the meander line 39 which is in turn joined to a downwardly depending portion 40 and to a folded back portion 42 of the meander line, having its distal end 44 connected by a member 46 to a ground plane 48 in the form of a conductive sheet. Ground plane 48 corresponds to the surface below which all of the antenna parts are mounted in this flush mount configuration. It will be noted that section 38 is a low impedance section, whereas section 42 is the high impedance section of the meander line. It will be appreciated that the antennas are fed by a balanced line indicated at 50 between points 52 and 54 on the opposed plates.

As illustrated, circumferentially attached to the ground plane is a submerged conductive cavity 54 which is joined both to ground plane 48 and to conductive elements 46 at an upper lip or periphery illustrated at 56. Thus, in essence all the meander line components of the antenna are within cavity 54 operated through the conductive sheet at an aperture there through.

The size of the cavity is described in terms of the cavity volume which in one embodiment is greater than 0.003 $\lambda^3$, where $\lambda$ is associated with the lowest frequency at which the antenna is to operate.

The bandwidth of the antenna is determined in part by the volume of the cavity. For an antenna which is to operate between 200 MHz and 2 GHz in one embodiment of the cavity its volume is the result of a top area of 11×11 inches, whereas the depth of the cavity is approximately five inches as determined by the Chu-Harrington formula. For antennas which are to operate in the range from 900 MHz to 3 GHz, the depth of the cavity can be reduced to one inch and the overall size of the antenna can be reduced to 2.9×2.9 inches.

Thus, for a wideband width antenna the overall size of the antenna is 11×11 inches by five inches in depth, whereas for a higher frequency antenna this is reduced to 2.9×2.9×1 inches in overall size.

Figure 4:
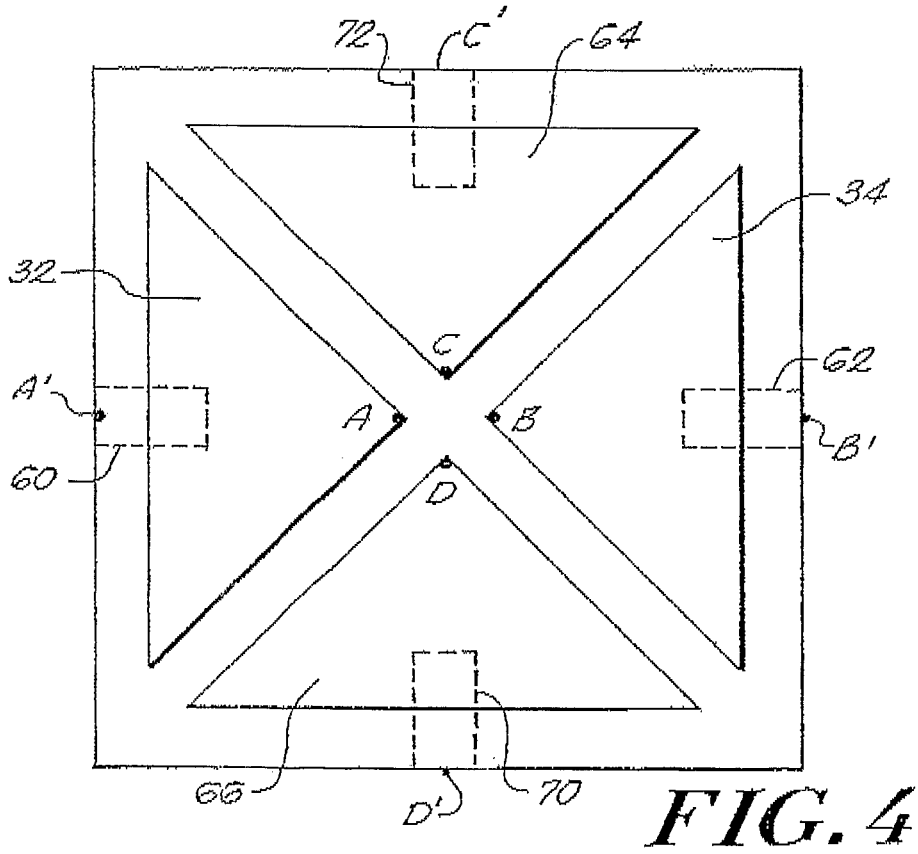
FIG. 4 is a diagrammatic and top view of the meander line loaded antenna of FIG. 3, illustrating a quad configuration of triangularly-shaped antenna elements to be able to generate outputs corresponding to right hand circular polarized and left hand circular polarized signals.

Referring now to FIG. 4, in one embodiment a quad type antenna is illustrated in which plates 32 and 34 of opposed triangular-shaped quad elements are illustrated with the associated meander line structures indicated in dotted outline at 60 and 62. The feed points for these triangular-shaped quad elements are shown at A and B, whereas for orthogonally oriented elements 64 and 66 the feed points are illustrated at C and D. Note, related meander line structures 70 and 72 are illustrated in dotted outline.

Figure 5:
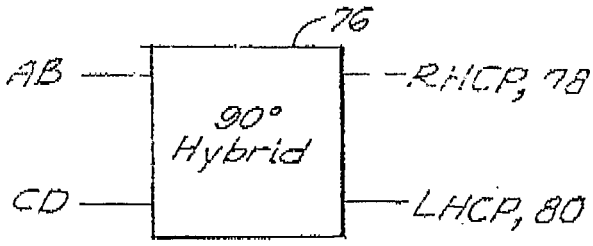
FIG. 5 is a block diagram illustrating the inputs to a 90-degree hybrid in which various outputs from the quad antenna elements of FIG. 4 are processed to produce right hand circular polarized signals and left hand circular polarized signals.

When, as illustrated in FIG. 5, feed point pairs AB and CD are coupled to a 90 degree hybrid, then the outputs of the hybrid are right hand circular polarized signals as illustrated at 78 and left hand circular polarized signals as illustrated at 80.

It will be appreciated that the recovery of right hand circular polarized and left hand circular polarized components is important in satellite communications. This is also important for terrestrial communications to establish 360-degree horizontal coverage.

Figure 6:
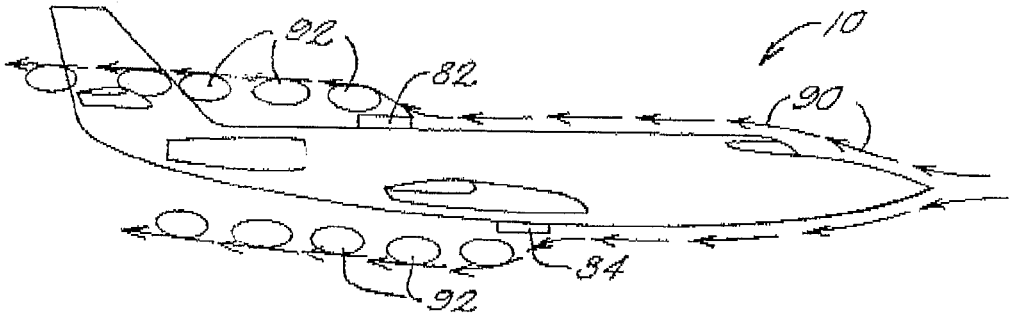
FIG. 6 is a diagrammatic illustration of the turbulence generated by an aircraft when non-flush mount antennas are utilized at the skin of the aircraft, with non-submerged meander line loaded antennas adding as much as five inches above or below the skin of the aircraft when the antennas are operated in a band between 200 MIHz and 2 GHz.

Referring to FIG. 6, it will be appreciated that were an aircraft 10 provided with traditional meander line above-the-ground plane antennas as illustrated at 82 and 84, then the airflow as illustrated generally at 90 would be turbulent at areas 92 aft of these antennas due to the sharp edges of the antennas which protrude from the skin of the aircraft. This limits the efficiency of the aircraft, with such protruding structures to be avoided.

Figure 7:
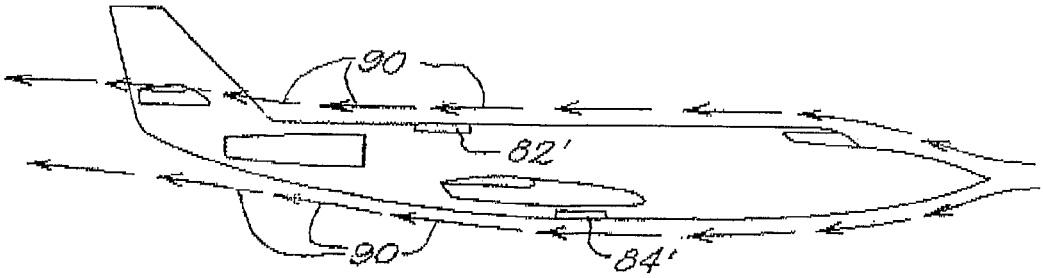
FIG. 7 is a diagrammatic illustration of embedded flush mounted meander line loaded antennas indicating the lack of turbulence generated when these antennas are flush-mounted to the skin of the aircraft.

Referring to FIG. 7, if these antennas here illustrated at 82' and 84' are flush mounted, then air streams 92 are linear over the skin of the aircraft, with the concomitant efficiency associated with laminar flow.

It will be appreciated that while circular polarized antennas can be provided through the subject quad configuration shown in FIGS. 4 and 5, a vertically polarized embodiment is possible with a different feed figuration. in this case elements having feed points at A, B, C and D which corresponds to the junctures of elements 46 with ground plane 48 for the various quad components, by feeding the antennas in this manner a vertically polarized antenna is achieved. What this means is that all of the antenna components are fed in phase.

Figure 8:
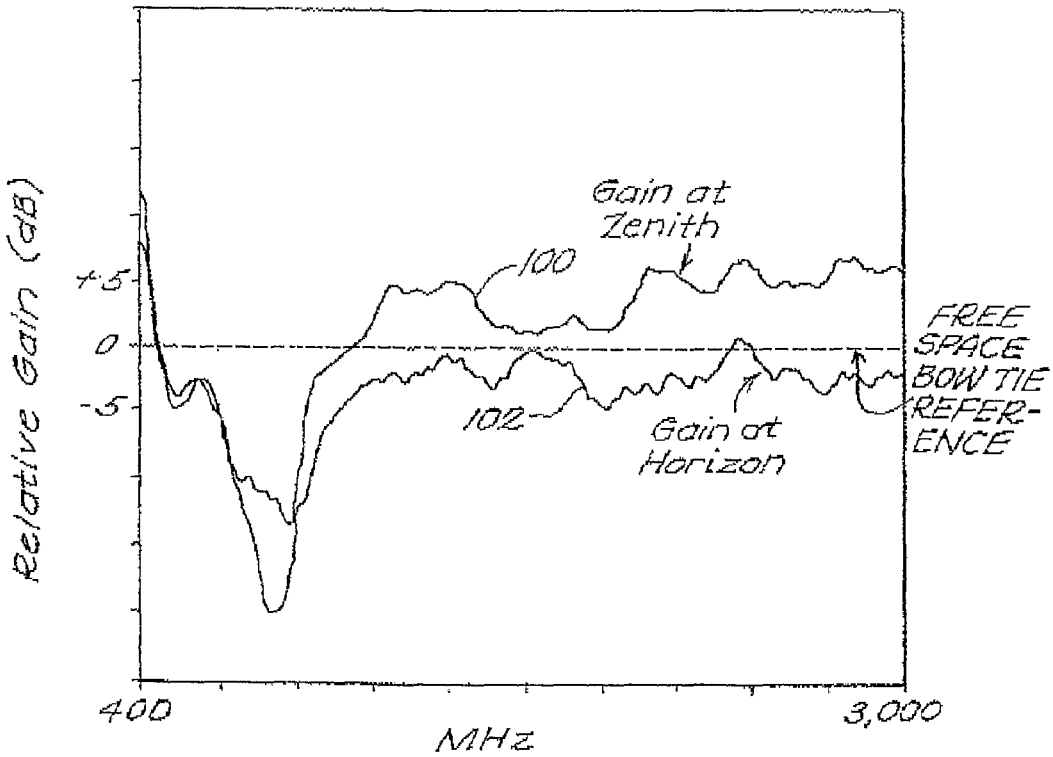
FIG. 8 is a graph of a relative gain at the zenith and at the horizon versus frequency for a 2.9 inch by 2.9 inch by 1.1 inch cavity size indicating, gains at that one would associate with meander line loaded antennas in an above-the-ground plane configuration.

Referring now to FIG. 8, what is shown is a graph of the gain of the antennas depicted in FIGS. 3 and 4 at the zenith and at the horizon as compared with a free space bow tie reference antenna. The relative gain is shown vis a vis the bow tie reference for frequencies starting at 400 MHz and in excess of 3 GHz. What can be seen here is that the gain at the zenith here illustrated at 100 is in the five dB range, whereas the gain at the horizon as illustrated at 102 is about zero dB, both consistent with the operation of above-the-ground plane meander line load antennas. The graph presented in FIG. 8 is for circular polarization loop type antennas.

Figure 9A:
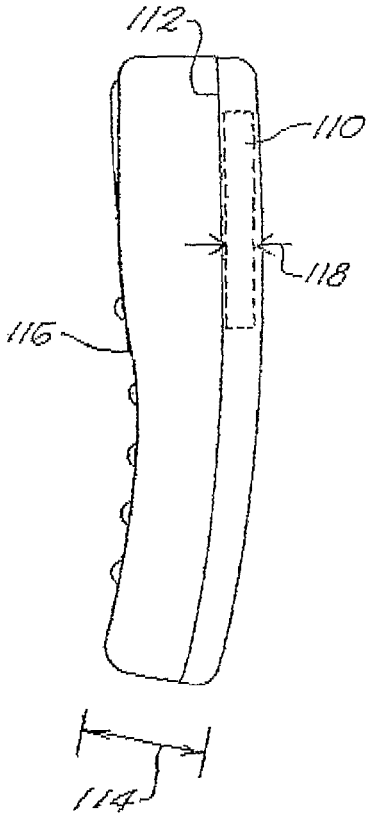
FIGS. 9A and 9B are diagrammatic illustrations of a wireless handset in which the thickness or width of the wireless handset maybe decreased by embedding the meander line loaded antenna such that its top surface is flush with a surrounding ground plane.
Figure 9B:
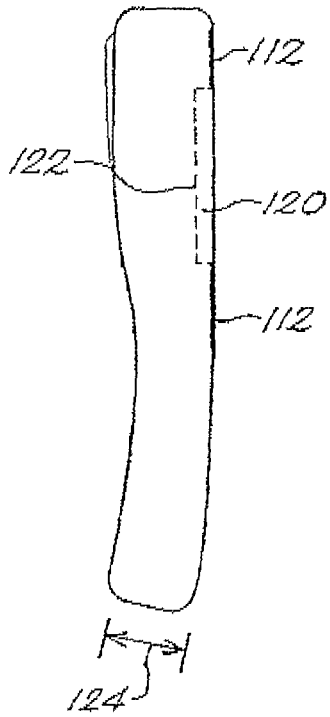

Referring now to FIGS. 9A and 9B, while the subject flush mount antenna has been described in connection with aircraft use, for hand portable devices such as wireless hand sets or for laptop applications, as illustrated in FIG. 9A in the past one had to mount an antenna 110 above a ground plane 112 such that the device thickness as illustrated by arrows 114 had to accommodate both the distance from the ground plane to the front 116 of the device and also the height 118 of the above-the-ground plane antenna plates. This means that for mobile or hand held devices the thickness depth of the device had to be increased to accommodate the above-the-ground plane antenna structure.

Referring to FIG. 9B, an internal flush mount antenna 120 is illustrated located in a cavity 122 surrounded by ground plane 112 such that the overall thickness or depth as illustrated by arrows 124 is significantly less than that associated with the same device as illustrated in FIG. 9A.

What will be appreciated is that with the flush mount internal antenna one is able to design a hand held or portable device which is thinner than would otherwise be possible utilizing an above-the-ground plane antenna. Moreover, the device with the flush mount internal antenna is mechanically more robust since the antenna is not subject to breaking off as would be the case with an above-the-ground plane antenna or in fact a whip antenna.

Figure 10:
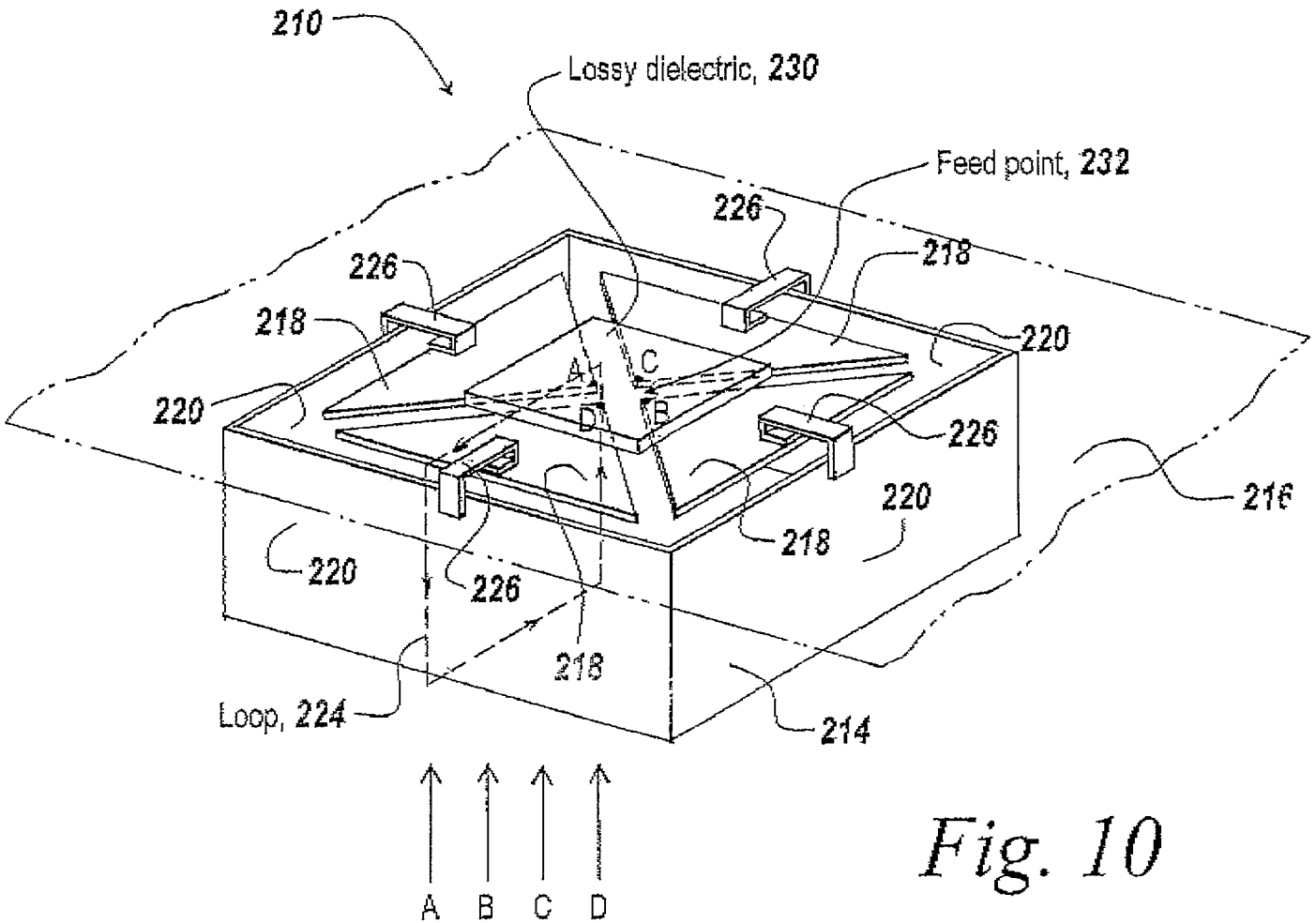
FIG. 10 is a diagrammatic illustration of an embedded meander line loaded antenna showing feed points A, B, C and D overlain with a lossy dielectric material, with the embedded meander line loaded antenna having a loop characteristic as illustrated.

Referring now to FIG. 10, an embedded loop type meander line loaded antenna 210 is shown having a cavity 214 which is countersunk in a conductive top surface 216. The meander line loaded antenna pictured is a quad type meander line loaded antenna with triangular plates 218 spaced from adjacent walls 220 of cavity 214.

The feed points for the diametrically opposite triangular shaped meander line plates are labeled A, B and C, D respectively. As will be appreciated, it is common to feed these points with balanced lines.

It will also be noted that there is a loop 224 going from the feed point across the associated plate down across the cavity wall, then laterally across the bottom of the cavity and then up again and it is for this reason that this particular antenna is classified as a loop type meander line loaded antenna.

Note that plates 218 are coupled by meander lines 226 to respective side walls 220 of the embedded cavity.

As illustrated, a lossy dielectric material 230 is placed across feed points A, B, C and D 232 and it is this lossy dielectric material, such as Eccosorb VF-30, that provides for the lowering of the VSWR below 3:1 below 1800 MHz.

Figure 11:
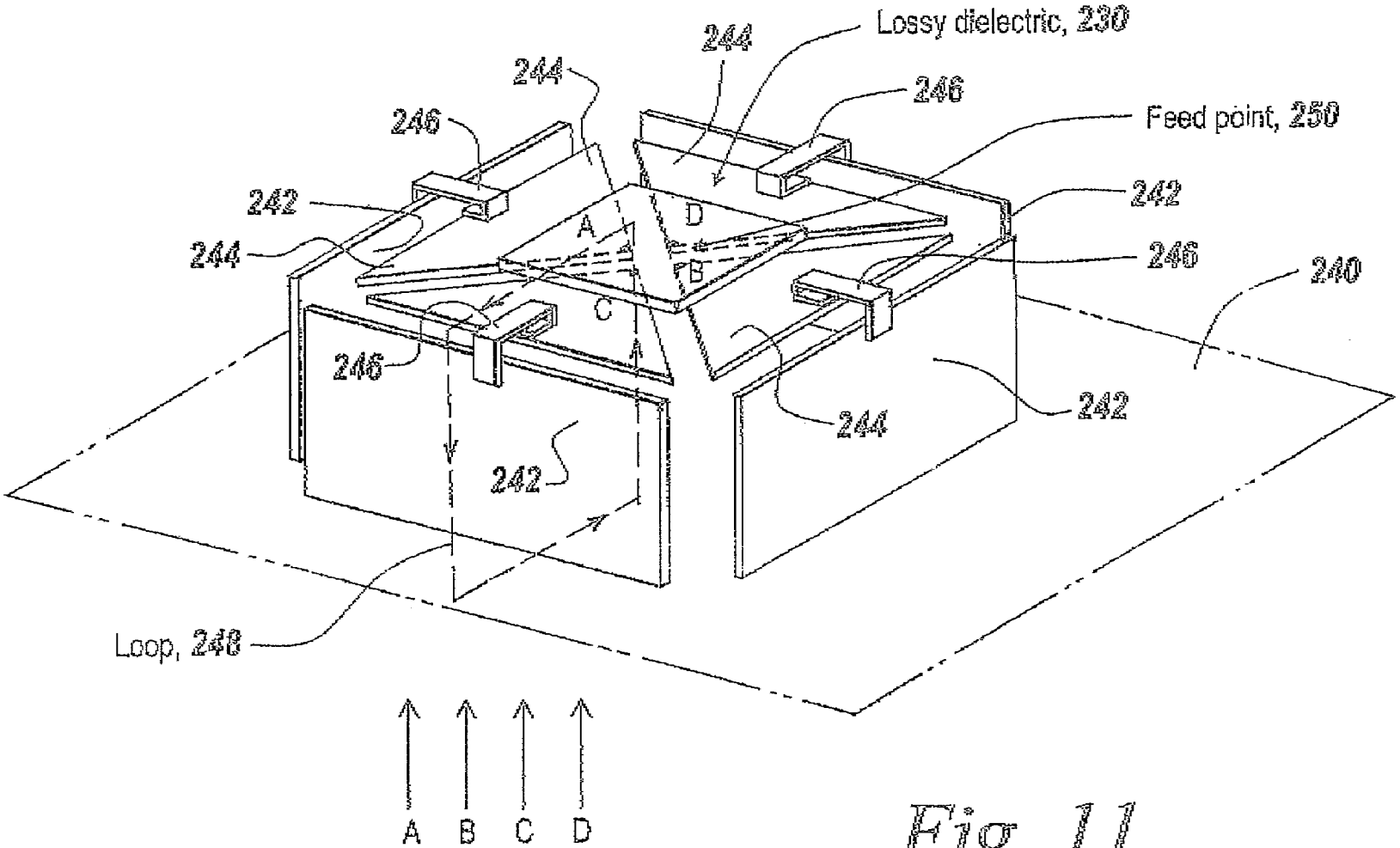
FIG. 11 is a diagrammatic illustration of a standard loop type meander line loaded antenna in which the meander line is connected to plates that are above a ground plane, again showing feed points, A, B, C and D overlain with the subject lossy dielectric layer.

Referring to FIG. 11, what is depicted is a standard loop type meander line loaded antenna in which a ground plane 240 is provided with upstanding plates 242, with the quad configuration of top plates 244 coupled by meander lines 246 to the corresponding side plates. It will be noted that a loop 248 is established by such a configuration from a feed point across the associated plate, through the meander line, through the upstanding plate and to the ground plane.

Feed points 250 for this loop type meander line loaded antenna are A, B and C, D as noted above.

It will be appreciated that lossy dielectric 230 is placed across feed points 250 to provide for the selfsame operation as that described in connection with the FIG. 10 embodiment.

Figure 12A:
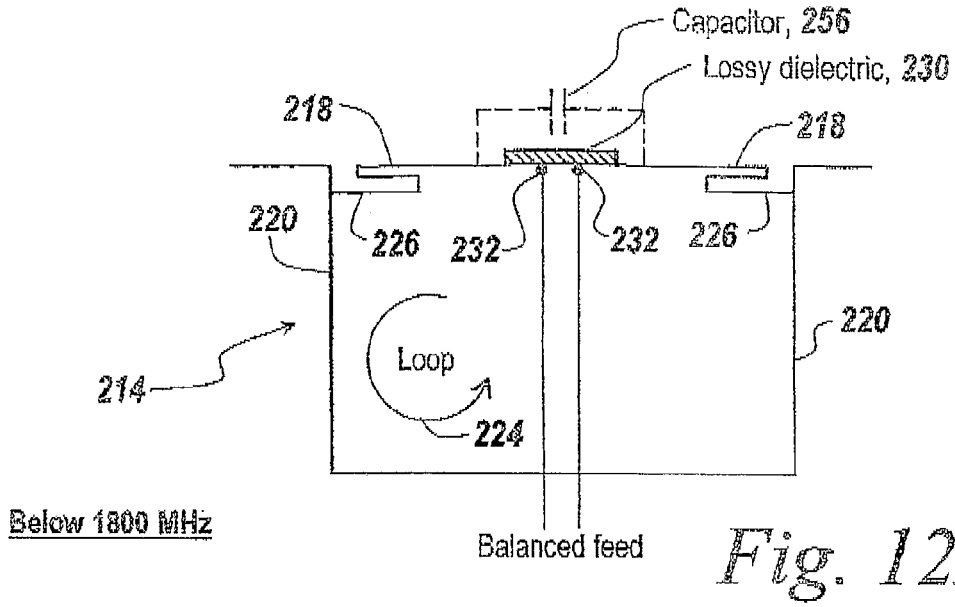
FIG. 12A is a schematic diagram of an embedded meander line loaded antenna showing the positioning of the lossy dielectric over the feed points to provide a capacitor below 1800 MHz, with the loop being as indicated.

Referring to FIG. 12A, wherein like cavity embedded meander line loaded elements are identical to those of FIG. 10, lossy dielectric 230 provides a capacitor shown in dotted outline at 226 to bridge feed points 222 below 1800 MHz.

Figure 12B:
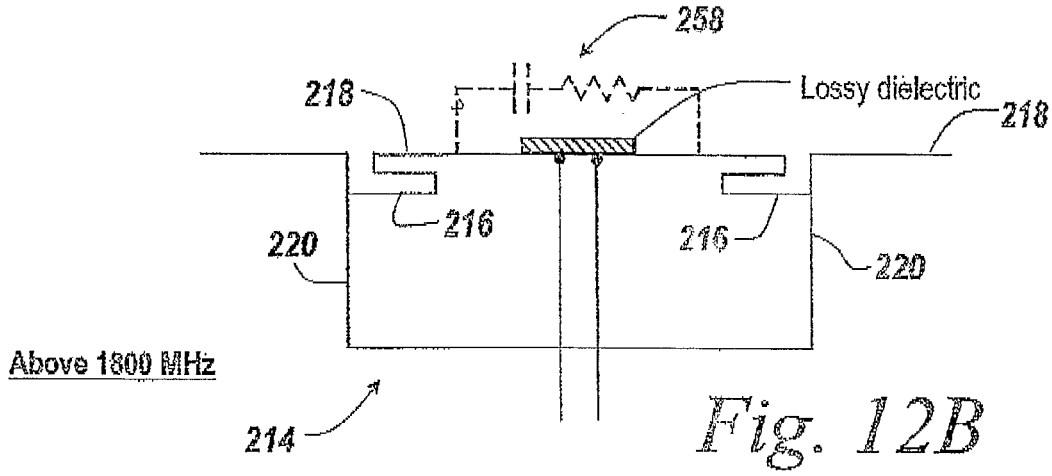
FIG. 12B is a diagrammatic illustration of the antenna of FIG. 3A in which above 1800 MHz the lossy dielectric is characterized by a capacitor in series with a resistor coupled across the feed points, thus to prevent shorting of the antenna feeds.

As illustrated in FIG. 12B, however, above 1800 MHz the dielectric functions as a series capacitor resistor network illustrated at dotted outline 258, such that above 1800 MHz it is as if the lossy dielectric did not exist across the feed point, thus preventing the capacitor that was associated with the dielectric below 1800 MHz from shorting out the feed point.

The result as indicated above is that the use of the lossy dielectric provides for a capacitive cancellation of the loop inductance below 1800 MHz, whereas above 1800 MHz the dielectric layer can be considered to be a series capacitor resistor combination which precludes the capacitor from shorting the feed above 1800 MHz.

Figure 13:
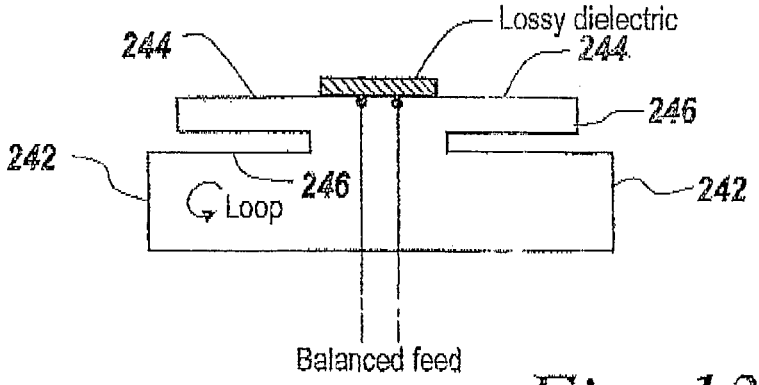
FIG. 13 is a diagrammatic illustration of a standard meander line loaded antenna illustrating the use of a lossy dielectric across the feed points and illustrating the loop.

Referring to FIG. 13, a schematic diagram of the standard loop type meander line loaded antenna is shown in which like reference characters are the same between FIGS. 11 and 13. Here lossy dielectric 230 functions identically to that described in FIGS. 12A and 12B.

Figure 14:
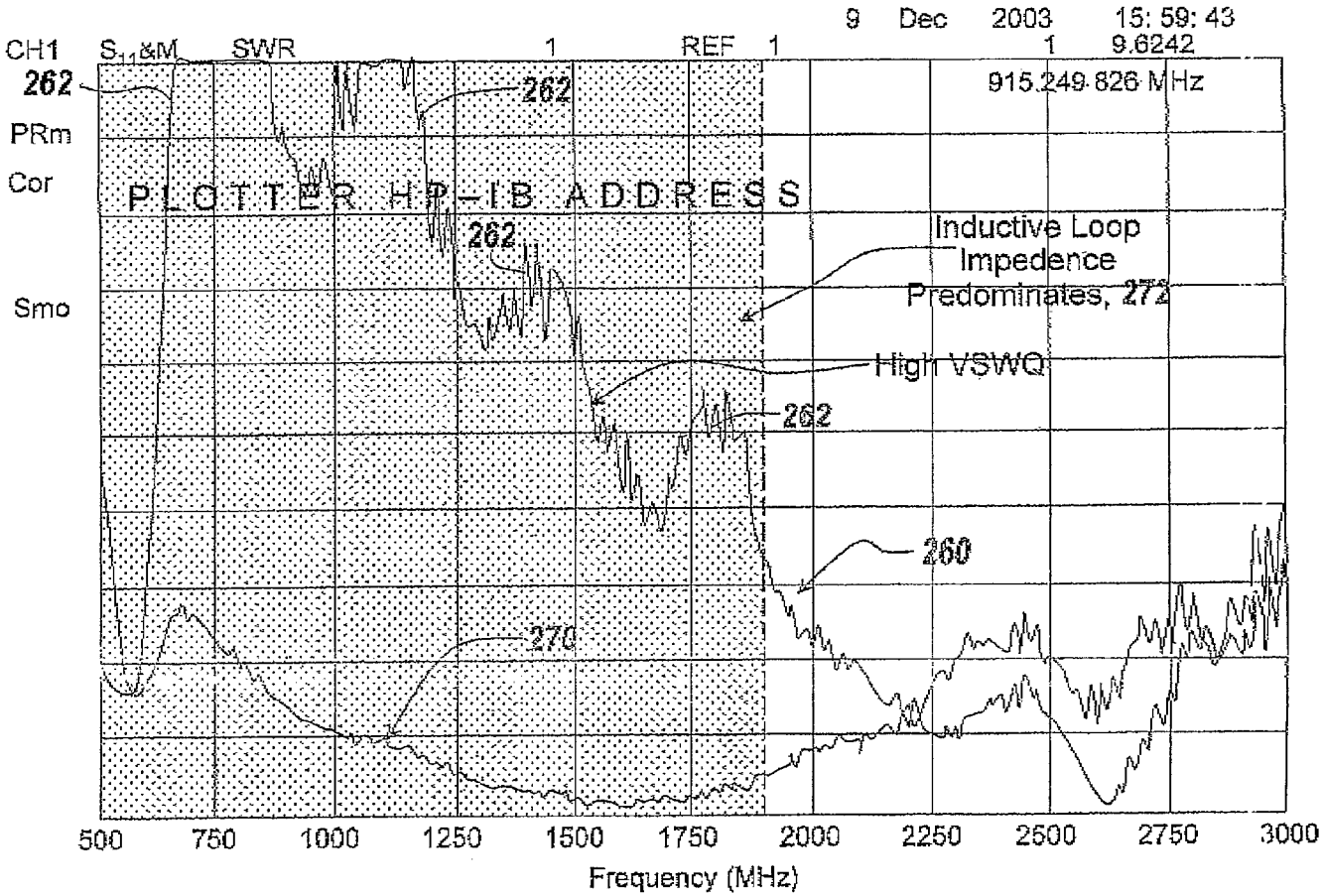
FIG. 14 is a graph of VSWR versus frequency for the loop type meander line loaded antenna of FIG. 1 both without the utilization of the lossy dielectric and with the placement of the lossy dielectric across its feed points, illustrating a dramatic improvement in VSWR at frequencies below 1800 MHz; and, FIG. 15 is a graph of gain versus frequency for the antenna of FIG. 1, showing that as compared with a dipole reference, the gain of the meander line loaded antenna at the zenith of the antenna is virtually indistinguishable from the gain of the reference dipole.

Referring to FIG. 14, what is illustrated is a VSWR plot 260 for the cavity embedded antenna of FIG. 10 in which the subject lossy dielectric layer is not used. Here it can be seen that the VSWR increases in dramatic spikes 262 below 1800 MHz.

However, referring to the VSWR trace 270, the VSWR of the antenna is markedly decreased and smooth below 1800 MHz due to the effect of the dielectric layer across the feed point.

Note that the shaded area 272 is where the inductive loop impedance predominates and it is in this region that the capacitive effect of the lossy dielectric also predominates to limit the VSWR. To the right of the shaded area 272, the VSWR of the antenna is virtually the same as it would have been without the lossy dielectric in place.

What will be appreciated from this graph is that one can provide a cavity embedded meander line loaded antenna with a wideband response from 500 MHz all the way up to 3000 MHz. This is a 6:1 bandwidth ratio. Here it can be readily seen that the bandwidth of the antenna is at least doubled due to the use of the lossy dielectric material across the feed points.

Figure 15:
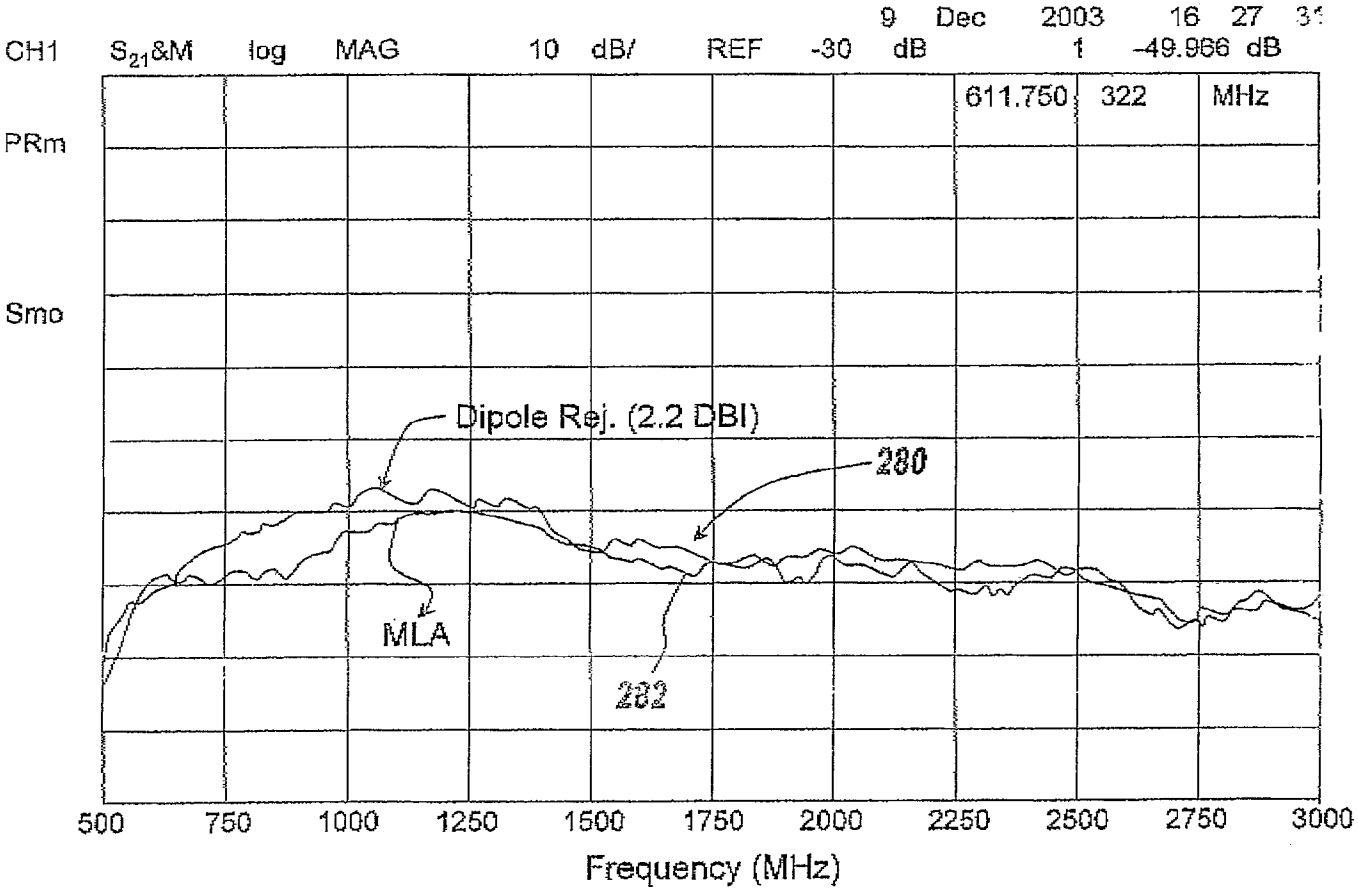

Referring to FIG. 15, the gain of the antenna of FIG. 10 at its zenith directly above the antenna is shown to track the gain of a reference dipole. Here the reference dipole gain trace versus frequency is illustrated at 280, whereas the gain trace for the meander line loaded antenna with the lossy dielectric is illustrated at 282.

What can be seen is that the gain of the loop type meander line loaded antenna is altered very little by the placement of the lossy dielectric layer over the feed points. The use of the lossy dielectric layer therefore is a powerful tool to increase the already wide bandwidth of a loop type meander line loaded antenna by effectively permitting energy to be readily pumped into the antenna at the lower frequencies.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for decreasing the VSWR of a loop type meander line loaded antenna having a feed comprising placing a strip of lossy dielectric material across the feed.

2. The method of claim 1, wherein the lossy dielectric material has a resistivity of 5-50 ohm-centimeters.

3. The method of claim 2, wherein the lossy dielectric material has a dielectric constant at 8.6 GHz of 37.

4. The method of claim 2, wherein the thickness of the lossy dielectric material strip is 0.30 inches.

5. The method of claim 1, wherein the lossy dielectric material includes a resistive plastic film.

6. The method of claim 1, wherein the lossy dielectric material includes a resistive vinyl plastic film that is conductive between 1 and 18 GHz.

7. A method of decreasing the VSWR of a loop type meander line loaded antenna having a feed, comprising:

placing a capacitor across the feed for frequencies below the frequency at which the antenna exhibits significant inductive reactance; and, placing a series connected capacitor and resistor across the feed for frequencies above the frequency at which the antenna exhibits significant inductive reactance.

8. The method of claim 7, wherein the capacitor and resistor are provided by a lossy dielectric material.

9. The method of claim 8, wherein the lossy dielectric material has a resistivity of 5-50 ohm-centimeters.

10. The method of claim 9, wherein the lossy dielectric material has a dielectric constant at 86 Hz of 37.

11. A wide bandwidth meander line loaded antenna, comprising:

a loop type meander line loaded antenna having a pair of top plates and a feed therebetween; and, a layer of lossy dielectric material across said feed, whereby the VSWR of said antenna is minimized across the bandwidth thereof.

12. The antenna of claim 11, wherein said loop type meander line loaded antenna is embedded in a conductive cavity.

13. The antenna of claim 11, wherein said antenna includes a ground plane plate and wherein said top plates are spaced from said ground plane plate.

14. The antenna of claim 11, wherein said layer of lossy dielectric material has a resistivity of 5-50 ohm-centimeters.

15. The antenna of claim 14, wherein said layer has a dielectric constant at 8.6 GHz of 37.

16. The antenna of claim 11, wherein said layer has a thickness of 3 inches.

17. The antenna of claim 11, wherein said layer includes a resistive plastic film.

* * * * *